United States Patent [19]

Flyborg et al.

[11] Patent Number: 4,694,645

[45] Date of Patent: Sep. 22, 1987

[54] PROPELLER ASSEMBLY

[75] Inventors: Nils O. Flyborg; Orvar Björheden, both of Kristinehamn, Sweden

[73] Assignee: Kamewa AB, Kristinehamn, Sweden

[21] Appl. No.: 736,533

[22] Filed: May 21, 1985

[30] Foreign Application Priority Data

May 23, 1984 [SE] Sweden ..... 8402792

[51] Int. Cl.[4] ..... B63H 11/00; F04D 7/00; B03H 1/16

[52] U.S. Cl. ..... 60/221; 60/232; 415/209; 415/210; 415/213 C; 415/217; 440/67; 114/166

[58] Field of Search ..... 60/221, 222, 232; 114/166; 415/209, 210, 216, 217, 213 C; 440/66, 67, 71, 72; 239/265.35

[56] References Cited

U.S. PATENT DOCUMENTS

| | | | |
|---|---|---|---|
| 2,369,279 | 2/1945 | Carnaghan et al. | 114/166 |
| 3,137,265 | 6/1964 | Meyerhoff | 60/221 |
| 3,314,392 | 4/1967 | Molas et al. | 440/66 |
| 3,457,891 | 7/1969 | Clark et al. | 114/166 |
| 3,528,382 | 9/1970 | Clark | 440/66 |
| 3,799,103 | 3/1974 | Granholm | 440/66 |
| 3,980,035 | 9/1976 | Johansson | 440/66 |
| 4,046,096 | 9/1977 | Liaaen | 440/67 |

FOREIGN PATENT DOCUMENTS

| | | | |
|---|---|---|---|
| 58034 | 1/1971 | Australia . | |
| 362250 | 5/1981 | Australia . | |
| 680652 | 8/1939 | Fed. Rep. of Germany . | |
| 740224 | 8/1943 | Fed. Rep. of Germany . | |
| 2346035 | 3/1974 | Fed. Rep. of Germany . | |
| 2916287 | 10/1980 | Fed. Rep. of Germany . | |
| 2950091 | 6/1981 | Fed. Rep. of Germany | 440/66 |
| 3042197 | 6/1982 | Fed. Rep. of Germany . | |
| 8004498 | 8/1980 | Netherlands . | |
| 1407559 | 9/1975 | United Kingdom . | |

*Primary Examiner*—Louis J. Casaregola
*Assistant Examiner*—Timothy S. Thorpe
*Attorney, Agent, or Firm*—Browdy & Neimark

[57] ABSTRACT

A propeller assembly, a so-called rotatable thruster, for propelling, manoeuvering, steering and/or positioning a watercraft, floating docks, pontoons and in particular offshore platforms, includes a propeller (1) having an embracing propeller shroud (2) and mounted on a propeller shaft journalled in a gear housing (3). The gear housing accommodates a bevel gearing through which the propeller shaft is connected to a drive shaft extending through a tubular support strut (4), which is connected at its lower end to the gear housing in order to support the same. The upper end of the support strut is arranged to be rotatably mounted in an opening in a bottom part of the hull of the watercraft, with the propeller shaft extending substantially horizontally, so that the drive shaft can be connected to drive machinery located within the hull and such that the assembly can be rotated about a rotational axis coinciding with the axis of the drive shaft, by means of rotational machinery located within the hull. The propeller shroud (2) is provided with means, for example guide vanes (10) and/or is in itself designed such that the propeller jet exiting from the shroud is directed slightly obliquely downwardly in relation to the direction of the propeller shaft. Advantageously there are arranged in the vicinity of the shroud outlet horizontal guide vanes (11) which deflect the propeller jet obliquely downwardly and radial guide vanes (12) which eliminate rotational movement in the propeller jet.

6 Claims, 7 Drawing Figures

PROPELLER ASSEMBLY

The present invention relates to a propeller assembly for propelling and/or steering various types of watercraft, primarily special-duty watercraft, such as vessels intended for diving work, crane-carrying vessel, cable-laying and cable-retrieving vessels, floating docks, pontoons, and particularly different kinds of offshore platforms. The propeller assembly is of a conventional kind, normally referred to as a rotatable thruster, and comprises a propeller which is enclosed by a propeller shroud and which is mounted on a propeller shaft journalled in a gear housing incorporating a bevel gearing, through which the propeller shaft is connected to a drive shaft which extends through a tubular strut, the lower end of which is connected to the gear housing for supporting the same. The upper end of the support strut is adapted for mounting in an opening in a bottom part of the hull of the watercraft, so that the drive shaft can be connected to drive machinery arranged within the hull of said craft. In the case of rotatable thrusters, the support strut is so mounted in the aforesaid opening in the bottom of the hull that the assembly comprising the support strut, the gear housing, the propeller and the propeller shroud can be rotated by means of the aforesaid machinery about an axis which coincides with the drive axis, so as to enable the propeller force generated by the assembly to be placed in any selected direction. Propeller assemblies of this kind are used to an ever increasing extent in connection primarily with the various types of watercraft used within the offshore industry. The propeller assemblies are used for propelling and/or positioning the watercraft, i.e. for holding the position of the watercraft in a given working location under varying weather conditions.

FIG. 1 of the accompanying drawings illustrates schematically and in side view an exemplifying embodiment of a conventional propeller assembly of the kind in question. As beforementioned, this known propeller assembly comprises a propeller 1 surrounded concentrically by a stationary propeller shroud 2 and mounted on a propeller shaft journalled in a gear housing 3. The gear housing 3 accommodates a bevel gearing through which the propeller shaft is connected to a vertical drive shaft, which extends through a tubular support strut 4, the bottom end of which is connected to and supports the gear housing 3. The upper end of the support strut 4 can be fitted to an opening 5 in a bottom part 6 of the hull 7 of the watercraft in question, only a part of the hull being shown in the figure. The drive shaft extending through the support strut 4 can be connected to drive machinery, generally referenced 8, located within the hull and adapted to drive the propeller. Also located within the hull is rotational machinery, generally referenced 9, which can be connected to the support strut 4 rotatably journalled in the mounting arrangement, such that the whole of the assembly comprising the support strut 4, the gear housing 3, the propeller shroud 2, and the propeller 1 can be rotated about a vertical axis coinciding with the drive axis. This enables the propeller thrust to be placed in any desired direction.

As illustrated schematically in FIG. 1, the propeller jet generated by the propeller 1 and exiting from the propeller shroud 2 has a certain spread or divergence. In stationary water the spread angle $\alpha$ of the propeller jet is about 10°. Because of the divergence or spread of the propeller jet certain power losses, so-called interference losses, are experienced in the majority of practical installations of a propeller assembly of this kind, due to the fact that the propeller jet impinges on adjacent shell-plating of the hull. When using propeller assemblies of this kind on offshore platforms, which often have a relatively complicated underwater structure comprising a plurality of mutually spaced pontoons, interference losses can also be experienced as a result of the propeller jet issuing from one propeller assembly mounted on one pontoon striking another pontoon. Moreover, such offshore platforms are often provided with a plurality of propeller assemblies, in which case the propeller jet from one propeller assembly may influence the working conditions of other propeller assemblies located downstream of the firstmentioned assembly. This also gives rise to interference losses.

In combination the aforesaid interference losses mean that the net power available from the installed propeller units is less than the gross power which can be obtained in theory by adding together the maximum propeller power capable of being generated by each of the propeller assemblies when assumed to work in free water. It will also be seen that these interference losses will vary in magnitude in dependence upon the directions in which the various propeller assemblies are directed. In the case of a typical installation, the power losses are on average in the order of 10–20%, although in the case of certain configurations and positional alignment of the propeller assemblies these losses can be even greater, reaching to 30%.

The object of the present invention is therefore to provide a propeller assembly of the aforementioned kind, which is so constructed as to eliminate or at least substantially reduce the aforementioned interference losses.

This is achieved in accordance with the invention by providing the propeller shroud with means and/or designing the actual propeller shroud in a manner such that the jet exiting from the propeller shroud is directed slightly obliquely downwardly in relation to the propeller axis substantially in the plane containing the propeller axis and the axis of the drive shaft. According to the invention a plurality of different structural designs are possible for achieving the aforesaid direction of the propeller jet.

The invention will now be described in more detail with reference to the accompanying drawing, in which FIG. 1 illustrated the aforedescribed conventional propeller assembly;

Figure 1:
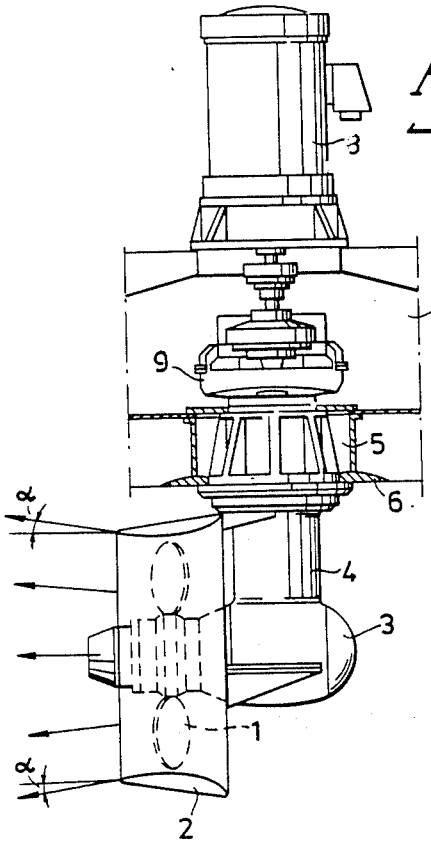
Figure 2:
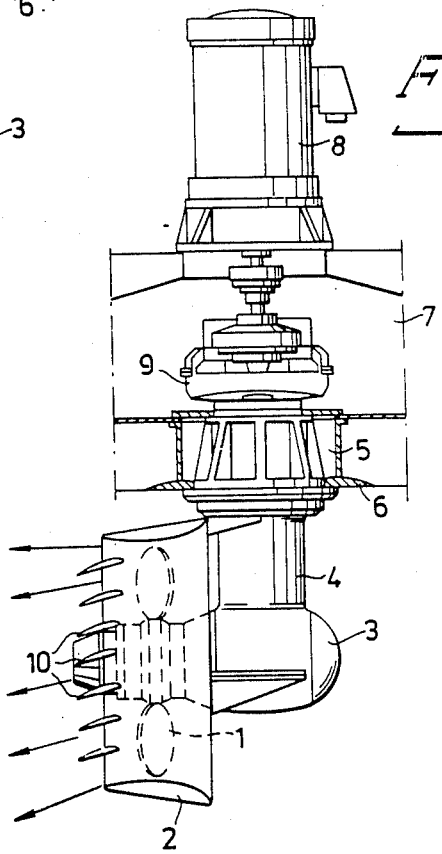
FIG. 2 is a schematic side view similar to FIG. 1 of a first embodiment of a propeller assembly according to the invention.

The propeller assembly according to the invention illustrated schematically by way of example in FIG. 2 is to a large extent of conventional design, for example as illustrated in FIG. 1. In the embodiment of a propeller assembly according to the invention illustrated in FIG. 2, however, the propeller shroud 2 is provided at its outlet end, downstream of the propeller 1, with an array of guide vanes 10, so formed and arranged as to direct the exiting propeller jet slightly obliquely downwardly in relation to the direction of the propeller shaft. The guide vanes may be made adjustable, so that the deflection angle of the propeller jet can be varied. In this respect an advantage may be gained by providing two mutually sequential arrays of guide vanes, of which the guide vanes located upstream are stationary while the guide vanes located downstream are adjustable to enable the deflection angle of the propeller jet to be varied.

Figure 3:
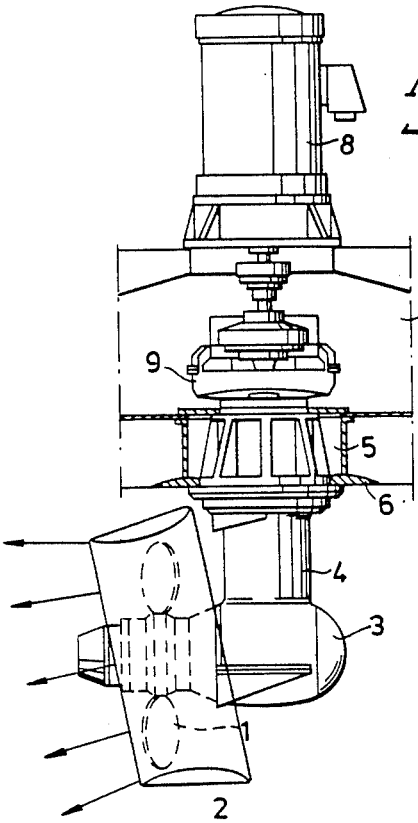
FIG. 3 illustrates in similar manner a second embodiment of a propeller assembly according to the invention.

A similar result is achieved with the embodiment of a propeller assembly according to the invention illustrated by way of example in FIG. 3, by obliquely positioning the propeller shroud 2, so that the geometric centre axis of the shroud forms an angle to the direction of the propeller shaft, and so that the propeller jet is directed slightly obliquely and downwardly in relation to the propeller shaft.

Figure 4:
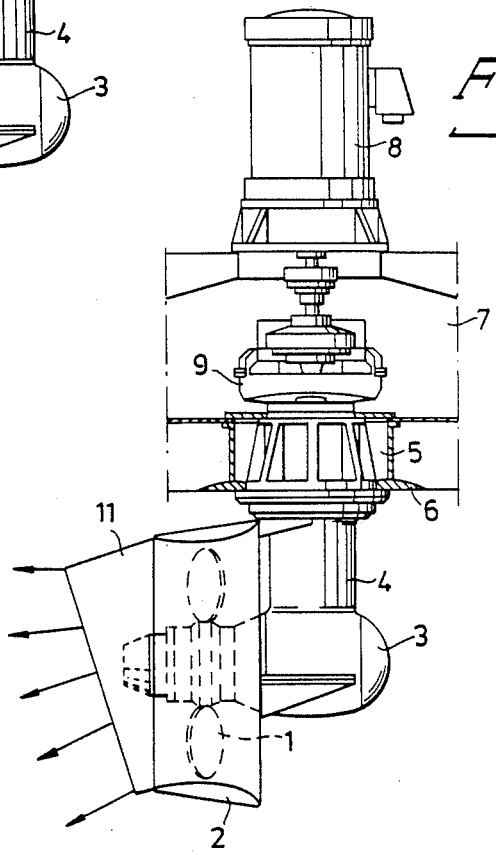
FIG. 4 illustrates in similar manner a third embodiment of a propeller according to the invention.

An obliquely downwardly directed propeller jet is obtained with the embodiment of a propeller assembly according to the invention and illustrate in FIG. 4 by providing the propeller shroud 2 at its outlet end with an obliquely downwardly directed extension nozzle 11.

The angle subtended by the exiting propeller jet and the direction of the propeller axis is suitably chosen within the range of 5°-15°, for example about 10°. Naturally the horizontal force component of the propeller jet will be reduced somewhat when the propeller jet is directed slightly obliquely downwardly, although this reduction is only in the order of 1-3% when the deflection lies within the aforesaid range. The guide vane arrangement also results in a certain amount of power loss, due to the flow resistance offered by the guide vanes.

It has been found possible to eliminate the aforementioned disadvantages by means of a particular propeller-jet deflecting guide-vane arrangement in the vicinity of the outlet end of the propeller jet is effected totally without loss in thrust or simple with a minor increase, about 1%, of the nominal thrust, compared with the case when no guide vanes are provided.

Figure 5:
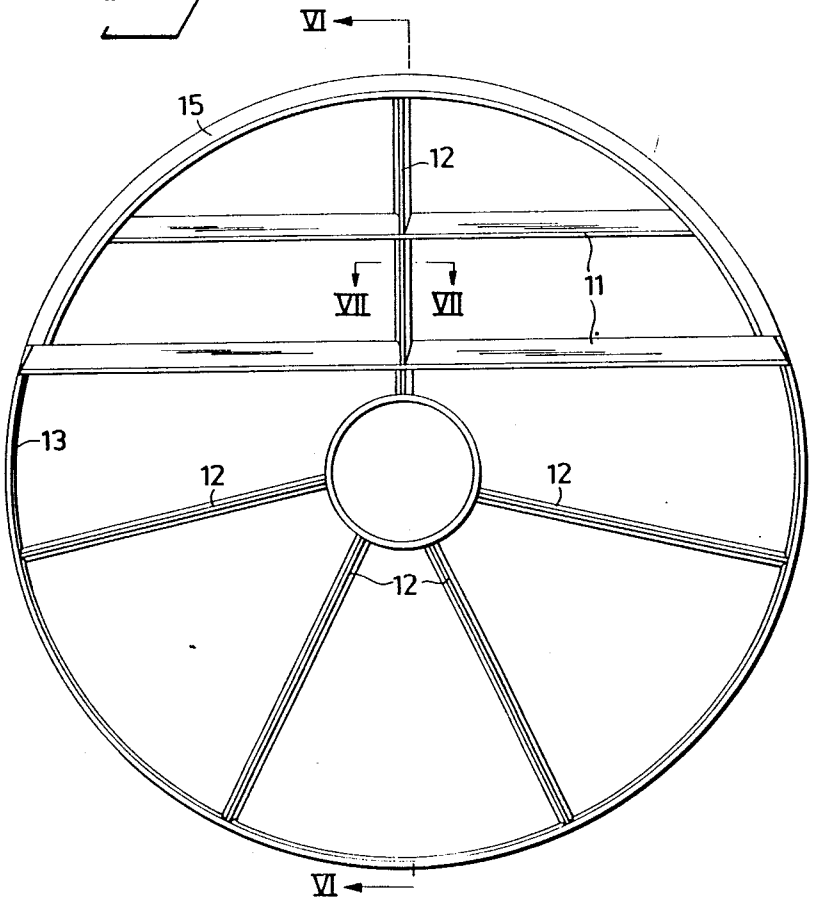
FIGS. 5, 6 and 7 illustrate a particularly advantageous embodiment of principly the kind illustrated in FIG. 2.
Figure 7:
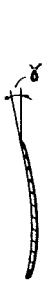
Figure 6:
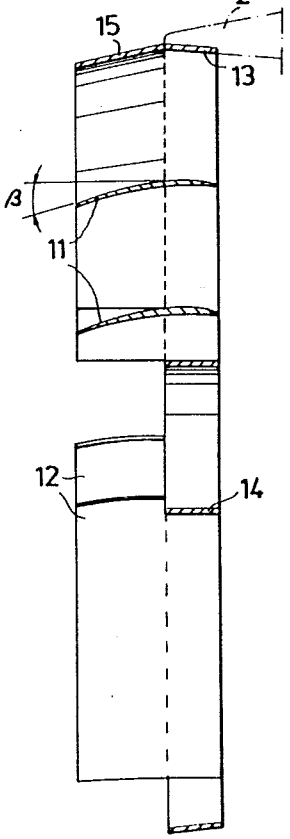

FIGS. 5, 6 and 7 illustrate by way of example an embodiment of one such advantageous guide vane arrangement, FIG. 5 illustrating the arrangement from behind, FIG. 6 being a sectional view of the arrangement taken on the line VI—VI in FIG. 5, FIG. 7 being a sectional view of one of the guide vanes taken on the line VII—VII in FIG. 5.

This particular arrangement of guide vanes is distinguished by the fact that it incorporates both a plurality of horizontal guide vanes 11, which are inclined in a manner to deflect the propeller jet obliquely downwards, and a plurality of radial guide vanes 12, the purpose of which is to eliminate the rotational movement generated by the propeller in the propeller jet. The guide vanes 11 and 12, are carried by an outer annulus 13, which is attached to the outlet end of the propeller shroud 2, of which only a part is illustrated schematically in FIG. 6, and an inner annulus 14.

Both the horizontal guide vanes 11 and the radial guide vanes 12 suitably have a curved "wing-shaped" cross-section, as illustrated in FIGS. 6 and 7 respectively. The angle of outlet $\beta$ for the horizontal guide vanes 11 can lie within the range 5°-20°, while the angle of incidence $\gamma$ of the guide vanes 12 is, for example, in the order of 2°.

It has been found suitable, both structurally and functionally, to postition the horizontal guide vanes 11 substantially solely within the upper half of the outlet opening of the propeller shroud 2, while the radial guide vanes 11 are positioned primarily in the lower half of said outlet opening of said shroud.

In the embodiment illustrated in FIGS. 5-7 the annulus 13 is provided around the upper part of its periphery with a so-called visor 15, i.e. a plate flange extending obliquely inwardly towards the centre axis of the propeller shroud 2, this visor assisting in deflecting the propeller jet obliquely downwardly.

Although the horizontal guide vanes 11 and the radial guide vanes 12 of the embodiment illustrated in FIGS 5-7 are shown to be arranged in substantially the same plane, this is not an absolute requirement of the invention, and the guide vanes can also be arranged in separate planes, for example the radial guide vanes may be positioned upstream of of the horizontal guide vanes. It will also be understood that other embodiments of a guide vane arrangement incorporating both horizontal and radial guide vanes are also conceivable.

It will also be understood that the various arrangements illustrated in FIGS. 2-7 for directing the exiting propeller jet slightly downwardly can also be used in various combinations with one another.

We claim:

1. A propulsion and steering apparatus which controls the direction of a propeller jet for mounting underneath the bottom part of a hull of a watercraft, comprising:

a propeller and a fixed propeller shroud embracing the propeller;

a propeller shaft on which said propeller is mounted;

a gear housing in which said propeller shaft is journalled and which accommodates a bevel gearing through which the propeller shaft is connected to a drive shaft extending perpendicular to said propeller shaft;

a tubular support strut surrounding said drive shaft and having a lower end connected to said gear housing for supporting said gear housing and an upper end adapted to be rotatably mounted in an opening in said bottom part of the hull of the watercraft with the axis of rotation of the support strut extending vertically and the propeller shaft extending in a substantially horizontal direction;

said propeller shroud being provided at its outlet end with stationary, substantially horizontally extending guide vanes positioned obliquely in relation to the direction of the propeller shaft so as to deflect a propeller jet generated and exiting from the propeller shroud upon rotation of the propeller obliquely downwardly in relation to the direction of the propeller shaft;

wherein the propeller shroud is provided at its outlet end also with stationary, substantially radial guide vanes for eliminating rotational movement in the propeller jet.

2. An apparatus as claimed in claim 1, wherein the propeller jet exiting from the shroud forms an angle of between 5° and 15° with the direction of the propeller shaft.

3. An apparatus as claim in claim 1, wherein said horizontal guide vanes are located substantially in the upper half of the outlet of the propeller shroud and said radial guide vanes are located primarily in the lower half of said outlet of the propeller shroud.

4. An apparatus as claim in claim 1, wherein said horizontal guide vanes are inclined with an outlet angle of 5°–20°.

5. An apparatus as claimed in claim 1 wherein said propeller shroud is provided along the upper part of its outlet edge with a flange which slopes obliquely inwardly towards the center axis of the shroud.

6. An apparatus as claimed in claim 1 wherein said horizontal and radial guide vanes have a slightly curved, wing-shaped cross section.

* * * * *